United States Patent [19]

Torre

[11] Patent Number: 4,658,241

[45] Date of Patent: Apr. 14, 1987

[54] SURVEILLANCE SYSTEM INCLUDING TRANSMITTER AND RECEIVER SYNCHRONIZED BY POWER LINE ZERO CROSSINGS

[75] Inventor: John J. Torre, Monroe, N.Y.

[73] Assignee: Allied Corporation, Morris Township, Morris County, N.J.

[21] Appl. No.: 777,062

[22] Filed: Sep. 17, 1985

[51] Int. Cl.[4] ..... G08B 13/24

[52] U.S. Cl. ..... 340/551; 340/572

[58] Field of Search ..... 340/572, 551

[56] References Cited

U.S. PATENT DOCUMENTS

| | | | |
|---|---|---|---|
| 4,274,090 | 6/1981 | Cooper | 340/572 |
| 4,384,281 | 5/1983 | Cooper | 340/572 |
| 4,476,459 | 10/1984 | Cooper et al. | 340/572 |
| 4,531,117 | 7/1985 | Nourse et al. | 340/572 |
| 4,565,996 | 1/1986 | Close | 340/572 |

*Primary Examiner*—Glen R. Swann, III

*Attorney, Agent, or Firm*—Ernest D. Buff; Gerhard H. Fuchs

[57] ABSTRACT

An article surveillance system includes a structure responsive to a first pulsed inductive magnetic field, periodically derived by a power line activated generator. The structure derives a second pulsed inductive magnetic field having a predetermined occurrence time relative to the occurrence time of the first magnetic field. A receiver for the second magnetic field is power line activated. The occurrence time of the first magnetic field and the activation time of the receiver to be responsive to the second magnetic field are synchronized. The synchronization of the transmitter and receiver is provided by separate zero crossing detectors for the power lines respectively activating the transmitter and receiver. The power lines activating the transmitter and receiver are likely to have zero crossings at different predetermined time positions because they are likely to be across two different phases of a three-phase power line. The receiver and transmitter includes separate circuits for compensating for the different zero crossing time positions.

18 Claims, 11 Drawing Figures

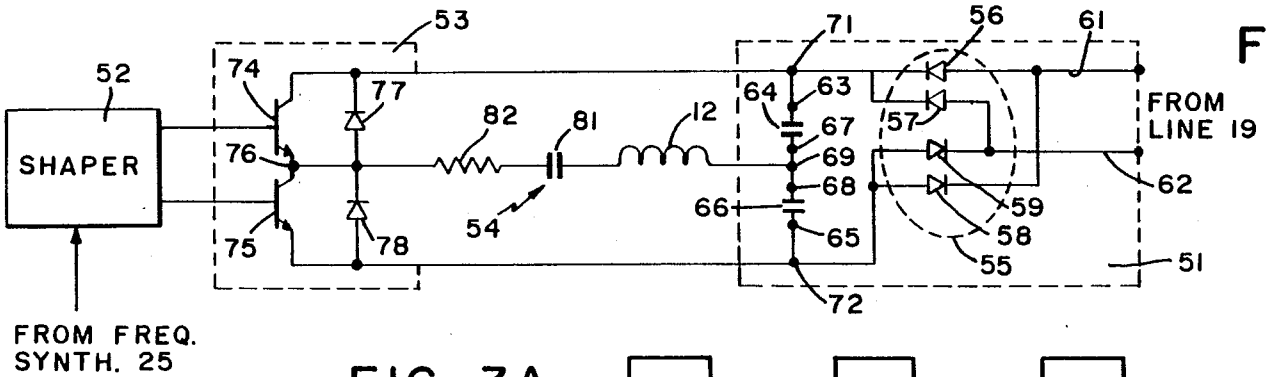
FIG. 2
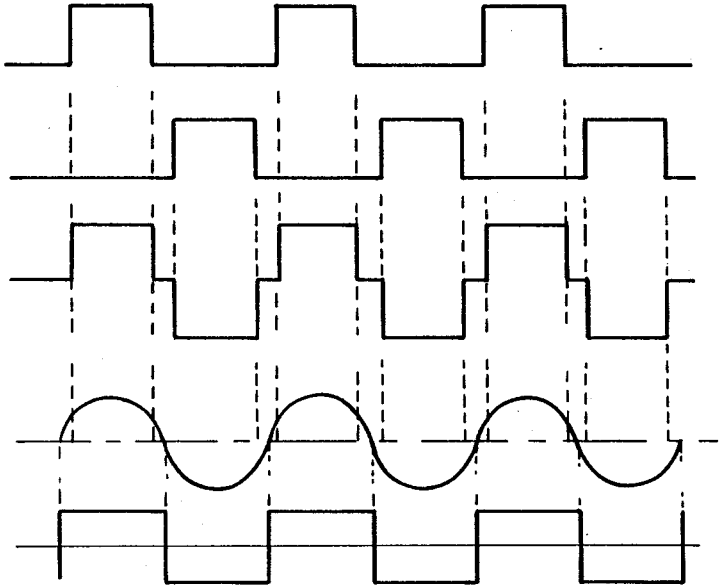
FIG. 3A
FIG. 3B
FIG. 3C
FIG. 3D
FIG. 3E

SURVEILLANCE SYSTEM INCLUDING TRANSMITTER AND RECEIVER SYNCHRONIZED BY POWER LINE ZERO CROSSINGS

TECHNICAL FIELD

The present invention relates generally to article surveillance systems and more particularly to an article surveillance system including a power line activated transmitter and a power line activated receiver wherein the transmitter and receiver are synchronized by zero crossings of the power lines energizing them.

BACKGROUND ART

An article surveillance system has been developed wherein a transmitter or generator periodically derives a first inductive magnetic field having a carrier frequency. The first magnetic field is coupled to a structure on a surveilled article. The structure resembles a tuned or resistance-inductance-capacitance (RLC) circuit. Upon completion of the first magnetic field, the structure radiates a second magnetic field having a frequency that is equal to or approximately equal to the frequency of the first field. A receiver for the second magnetic field is activated in synchronism with the derivation of the second magnetic field. Preferably, the receiver is effectively disabled while the first magnetic field is being derived so that the first magnetic field is not detected as the field associated with the structure.

The receiver detects the occurrence of the second magnetic field for a predetermined time to indicate the presence of the surveilled article. In the preferred prior art receiver, the detection process involves synchronously demodulating a replica of the second magnetic field as incident on a pick up coil arrangement of the receiver. The length of time that a synchronous demodulator derives an output having a frequency equal to the frequency of the second magnetic field provides a measure of the length of time that the second magnetic field is incident on the coil arrangement. The length of time is determined by an integration process that is initiated immediately after expiration of the first magnetic field and has a predetermined duration determined by the band width of the detection process. While the first magnetic field is being derived, the synchronous demodulator and an integrator means are effectively decoupled from the receiver coil arrangement by reducing the gain of an amplifier between the coil and synchronous demodulator to zero. Thus, it is important to provide synchronization between the derivation of magnetic field pulses from the transmitter and operation of the receiver.

In the past, synchronization between the transmitter and receiver of article surveillance systems has been usually attained by physically linking the transmitter and receiver with a hard wire cable, activated by a periodic source, e.g. an oscillator which is a part of the transmitter. The oscillator causes the transmitter to supply periodic pulses to the receiver via the hard wire cable. The use of a hard wire cable between the transmitter and receiver results in a further installation expense of the article surveillance system because of the desire to hide any wires which extend through the region where the transmitter and receiver are located. Seemingly, the need for a cable between the transmitter and receiver can be obviated by utilizing electric and/or magnetic fields to synchronize the transmitter and receiver. However, the use of such fields is beset with pitfalls, particularly because of likely interference.

It is, accordingly, an object of the present invention to provide a new and improved article surveillance system including a synchronized transmitter and receiver.

A further object of the invention is to provide a new and improved article surveillance system wherein synchronization of a transmitter and receiver is attained without any added wires between the transmitter and receiver, as well as without the need for electric or magnetic fields between the transmitter and receiver.

SUMMARY OF INVENTION

In accordance with the present invention, an article surveillance system is provided wherein a structure responds to a first pulsed inductive magnetic field to derive a second pulsed inductive magnetic field having a predetermined occurrence time relative to the occurrence time of the first magnetic field. The system includes power line activated transmitter means for periodically deriving the first pulsed inductive magnetic field. Power line activated receiver means responds to the second pulsed inductive magnetic field. The occurrence time of the first magnetic field and the activation time of the receiver means are synchronized so that the receiver means is activated while the second magnetic field is incident on coil means of the receiver means. Synchronization is provided by first and second separate zero crossing detectors for power lines activating the transmitter means and the receiver means. The first and second zero crossing detectors are respectively included in the transmitter and receiver means.

Most article surveillance systems are installed in facilities, such as retail store establishments, wherein a conventional single-phase power line, operating at 115 volts, 60 Hz (in the United States) is derived from a three-phase line. Because of this factor, the phases at outlets energizing the power line activated transmitter and the power line activated receiver are not necessarily the same. Frequently, the phases at the power line activated transmitter and receiver are displaced from each other by 120° or 240°. Hence, the zero crossings at the outlets energizing the transmitter and receiver are likely to be displaced from each other by 60° or 120° of the power line frequency.

It is, accordingly, another object of the present invention to provide a new and improved article surveillance system including a transmitter and receiver synchronized by power line zero crossings wherein compensation is provided for the likelihood of the transmitter and receiver being connected to power line outlets having different phases.

To solve the problem of the power line outlets having different phases, at least one of the power line activated transmitter or receiver means includes means for compensating for the different predetermined time positions of the zero crossings. In the preferred embodiment, the compensating means for one of the transmitter and receiver means includes preset counter means responsive to a signal having an occurrence time controlled by the zero crossing time of the power line activating said one transmitter or receiver means. Switch means selectively controls the preset count of the counter means.

The above and still further objects, features and advantages of the present invention will become apparent upon consideration of the following detailed description of one specific embodiment thereof, especially when taken in connection with the accompanying drawings.

BRIEF DESCRIPTION OF DRAWING

FIG. 2 is a circuit diagram of a transmit circuit included in FIG. 1;

FIGS. 3A–3E are waveforms useful in helping to describe the operation of FIG. 2;

BEST MODE FOR CARRYING OUT THE INVENTION

Figure 1:
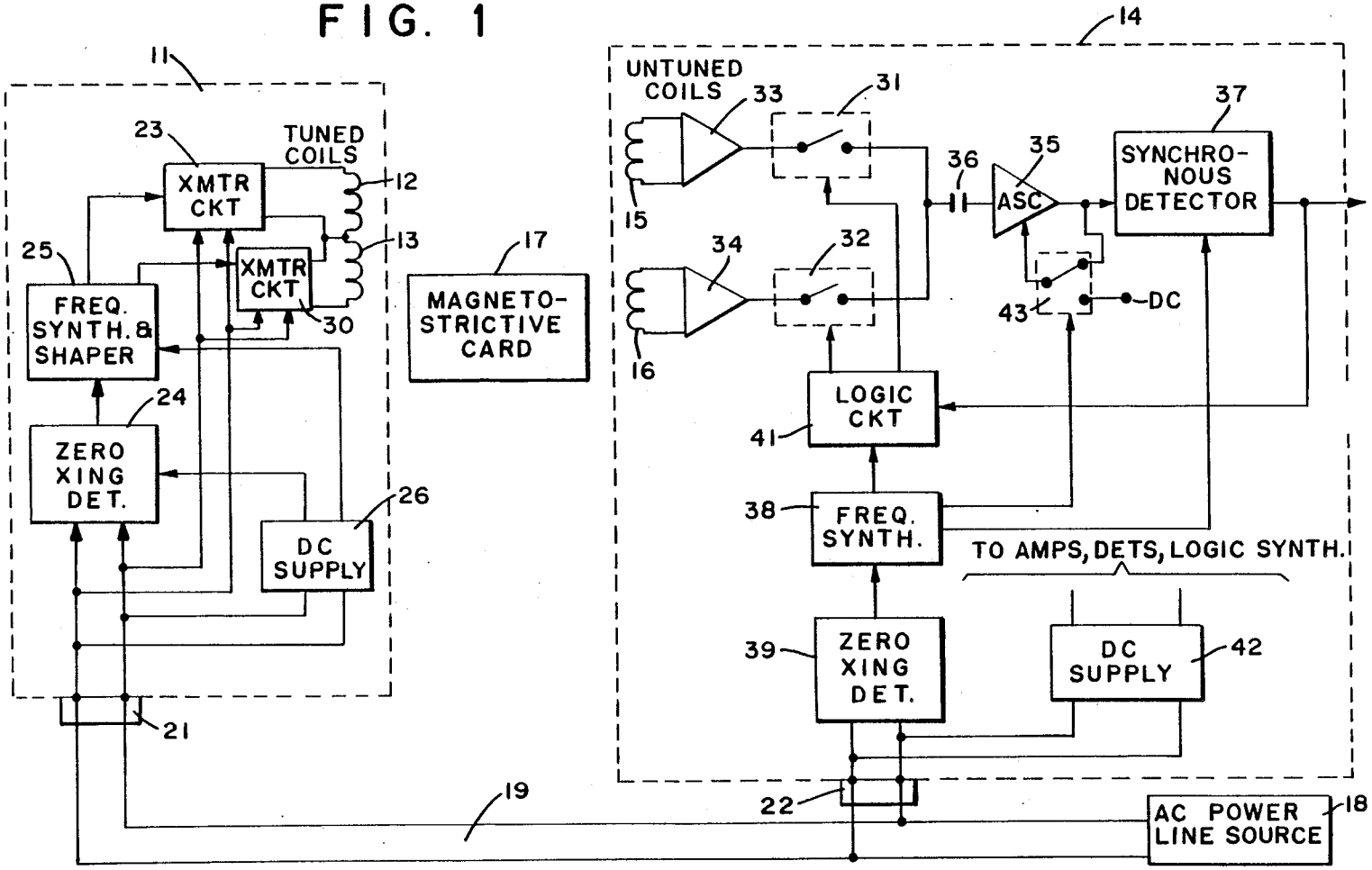
FIG. 1 is a block diagram of an article surveillance, system including a magnetic field generator in accordance with the present invention.

Reference is now made to FIG. 1 of the drawing wherein there is illustrated a surveillance system incorporating the present invention. The surveillance system includes a power line activated inductive magnetic field generator or transmitter 11 having an on-off duty cycle considerably less than 50%. While generator 11 is activated into the on duty cycle portion, it derives a first AC magnetic field having a predetermined frequency, typically 60 KHz. In the preferred embodiment, the duty cycle is approximately 6.4%, achieved by having on and off duty cycle portions with durations of 1.6 and 23.4 milliseconds, respectively. The magnetic field derived by generator 11 is inductively coupled from tuned coils 12 and 13, located on one wall of a region to be monitored.

Inductive AC magnetic field power line activated receiver 14 is selectively responsive to the magnetic field derived by generator 11. Receiver 14 includes untuned magnetic field responsive coils 15 and 16, mounted on a wall opposite from the wall containing coils 12 and 13. AC magnetic field inductive coupling subsists between coils 12 and 13 and at least one of coils 15 and 16 while coils 12 and 13 derive the magnetic field generated by transmitter 11. However, receiver 14 is effectively decoupled from coils 15 and 16 while coils 12 and 13 are energized. A second inductive magnetic field having a fixed predetermined carrier frequency but variable duration and amplitude is coupled to coils 15 and 16 of receiver 14 immediately after expiration of the on duty cycle portion of transmitter 11 when an article containing magnetostrictive card 17 passes in the region between the walls containing coils 12, 13 and 15–16. The second field is detected and recognized by receiver 14 as being associated with the article passing between coils 12, 13 and 15, 16.

Card 17 is preferably manufactured in accordance with the teachings of commonly assigned U.S. Pat. No. 4,510,489, to Anderson III, et al. Typically, card 17 is carried on an article to be detected by an interaction of components in the card and the magnetic field derived from generator 11 and transduced by receiver 14. Card 17 is normally in an activated state, wherein it effectively functions as a resistance-inductance-capacitance (RLC) circuit that responds to the AC inductive magnetic field derived by generator 11. Card 17 stores the magnetic field derived from generator 11. When a pulse of the first magnetic field has terminated, the elements in magneto-strictive card 17 re-radiate the second magnetic field that is detected by receiver 14. Magneto-strictive card 17 is selectively deactivated by an appropriate operator, such as a checkout cashier, causing the AC inductive magnetic field re-radiated by the card to be undetectable by receiver 14.

Transmitter 11 and receiver 14 are synchronously activated in response to zero crossings of AC power line source 18, to enable the receiver to respond to the inductive magnetic field re-radiated from card 17 upon completion of an on duty cycle portion of transmitter 11. By synchronizing the operation of generator 11 and receiver 14 in response to zero crossings of AC power line source 18, electronic circuits included in the generator and receiver need not be electrically connected together, except by power line 19 that is connected to conventional male plugs 21 and 22 of the generator and receiver, respectively.

Generator 11 includes transmitter circuits 23 and 30 for separately and simultaneously driving tuned coils 12 and 13 with a 60 KHz carrier having a 6.4% duty cycle, such that coils 12 and 13 are supplied with sinusoidal currents at a predetermined constant frequency of 60 KHz for 1.6 milliseconds. For the next 23.4 milliseconds, coils 12 and 13 are not driven by transmitter circuits 23 and 30.

Transmitter circuits 23 and 30 are identical, with each including a transformerless AC power line to DC converter and switch means that supplies currents from opposite terminals of the AC to DC converter to coils 12 and 13 at the 60 KHz frequency, during the on duty cycle portions. To these ends, transmitter circuits 23 and 30 are directly responsive to the AC power line voltages on line 19, as coupled to generator 14 by way of male plug 21. Transmitter circuits 23 and 30 are activated into the on duty cycle portions thereof in synchronism with zero crossings of the AC voltage of power line 19, as coupled to generator 11 by way of plug 21, a result achieved by connecting zero crossing detector 24 to plug 21 so the detector derives a pulse each time the voltage on power line 19 goes through a zero value. The zero crossing indicating pulses derived by detector 24 are coupled to frequency synthesizer and shaper 25, having outputs fed to transmitter circuits 23 and 30, to cause the transmitter circuits to be activated to produce the 60 KHz bursts having the 6.4% duty cycle.

DC power is supplied to components in zero crossing detector 24 and frequency synthesizer and shaper 25 by DC supply 26, connected to line 19 by male plug 21. Supply 26 does not have the capability of providing sufficient power to derive the necessary AC inductive magnetic fields from coils 12 and 13 to be a power supply for transmitter circuits 23 and 30.

Transmitter circuits 23 and 30 are responsive to frequency synthesizer and shaper 25 so that both the transmitter circuits are simultaneously activated to simultaneously derive the same frequency during the on duty cycle portion of each activation cycle of the transmitter circuits. During alternate on duty cycle portions, transmitter circuits 23 and 30 supply in phase and out of phase currents to coils 12 and 13. Thus, during a first on duty cycle portion, the currents supplied by transmitter circuits 23 and 30 to coils 12 and 13 cause current to flow in the same direction through the coils, relative to a common terminal for the coils. During the next, i.e., second, on duty cycle portion, the currents supplied by transmitter circuits 23 and 30 to coils 12 and 13 flow in opposite directions in the coils relative to the common coil terminal.

Such a result is achieved by synthesizer 25 activating switches in transmitter circuits 23 and 30 so that the switches are activated in the same sequence, at the 60 KHz frequency, during the first duty cycle portion. During the second duty cycle portion, the switches in transmitter circuits 23 and 30 are operated in opposite manners in response to switching signals from frequency synthesizer and shaper 25 to cause the AC currents in coils 12 and 13 to have opposite relative polarities. Thus, for example, the switches of transmitter circuit 23 are always driven in the same sequence. In contrast, the switches of transmitter circuit 30 are driven during a first duty cycle portion in the same sequence as the switches of transmitter circuit 23, but during the next duty cycle portion, the activation times of the switches in transmitter circuit 30 are reversed relative to the activation times of the transmitter circuit 30 during the preceding burst.

By driving coils 12 and 13 with in phase and out of phase currents during different duty cycle portions, mutually orthogonal magnetic fields are derived from generator 11. This enables untuned coils 15 and 16 of receiver 14 to transduce the second magnetic fields a card 17, regardless of the orientation of the card relative to coils 12 and 13. The result is achieved even though coils 12, 13, 15 and 16 are all vertically disposed planar loops of wire. The loops forming coils 12 and 13 are preferably non-overlapping rectangular loops having vertically and horizontally disposed sides.

In response to coils 12 and 13 being driven by in phase currents by circuits 23 and 30 to produce in phase magnetic field flux lines, i.e., flux lines that are directed in the same direction in the centers of the loops, a horizontally directed field at right angles to the plane of the loops is produced in the vicinity of adjacent wires of the loops forming coils 12 and 13. The magnetic flux lines between the centers of the loops forming coils 12 and 13, on one side of the plane of the loops, are oppositely directed in the vertical direction on opposite sides of adjacent wires of the loops forming coils 12 and 13.

Hence, in response to the stated in phase magnetic fluxes in the loops forming coils 12 and 13, there is a relatively intense magnetic flux field to provide X axis coverage for the magnetic field responsive elements in card 17 but there is a weak vertical magnetic field due to the cancellation effect of the oppositely directed vertical fields.

A vertically directed magnetic flux field in the region between tuned transmitter coils 12 and 13 and untuned coils 15 and 16 is provided by driving the loops forming coils 12 and 13 so the magnetic fluxes generated in the centers of the loop flow in opposite directions, i.e., have an out of phase relationship. The out of phase relationship for the fluxes of loops 12 and 13 causes the lines of flux to flow in opposite directions and cancel in the vicinity of adjacent, horizontally disposed conductor segments of the loops forming coils 12 and 13. The magnetic flux lines between the centers of the loops forming coils 12 and 13, on one side of the plane of the loops, are directed in the same vertical direction to cause the coils to be effectively a single coil. The vertically directed fluxes provide Z axis coverage for the magnetic field responsive elements in card 17.

The fringing fields resulting from the in phase and out of phase activation of the loops forming coils 12 and 13 provide magnetic flux vectors in the Y axis, i.e., in horizontal planes parallel to the planes containing the loops of tuned transmitter coils 12 and 13 and untuned receiver coils 15 and 16. Thereby, magnetic flux fields in three mutually orthogonal directions are derived from the loops forming coils 12 and 13 by virtue of the in phase and out of phase drives for these coils during different on duty cycle portions of transmitter circuits 23 and 30. These mutually orthogonal magnetic flux vectors provide coupling to enabled magneto-strictive card 17, regardless of the orientation of the card relative to the plane containing planar coils 12 and 13.

When an activated magneto-strictive card 17 is in the region between tuned coils 12, 13 and untuned coils 15, 16 at least one of the untuned coils derives an electric signal that is a replica of the AC magnetic field derived from card 17. Because untuned coils 15 and 16 have different non-overlapping spatial positions and coverage areas relative to each other, and card 17, as well as coils 12 and 13, there is a fairly high likelihood of the electric signals transduced by coils 15 and 16 differing from each other.

Receiver 14 determines if either of coils 15 or 16 is transducing a signal having the predetermined frequency, time duration and threshold amplitude necessary to signal the presence of an activated card in the region between coils 12, 13 and coils 15, 16. The voltages generated by coils 15 and 16 are sequentially coupled to the examining or detecting circuitry of receiver 14 during activation times synchronized with each 1.6 millisecond, 60 KHz on duty cycle burst from generator 11. After a first burst one of coils 15 or 16 is effectively coupled to the remainder of receiver 14; after the following burst the other one of coils 15 or 16 is effectively coupled to the remainder of the receiver. In response to one of coils 15 and 16 generating a voltage having the required frequency, duration and amplitude values, the sequential coupling of the coils 15 and 16 to the remainder of receiver 14 is terminated. Coils 15 and 16 are activated in such a situation so that the coil which generated the voltage having the desired frequency, duration and amplitude is the only coil coupled to the remainder of receiver 14, until that coil is no longer receiving a burst having the required frequency, duration and amplitude characteristics. Thereafter, coils 15 and 16 are sequentially and alternately coupled immediately after different bursts from generator 11 to the remaining circuitry of receiver 14.

To these ends, the voltages transduced by untuned coils 15 and 16 are respectively coupled to normally open circuited switches 31 and 32 by way of preamplifiers 33 and 34. During normal operation when no magnetic field having the desired characteristics is coupled to either of coils 15 or 16 in response to a burst from generator 11, one of switches 31 or 32 is closed for 25 milliseconds simultaneously with the beginning of a 1.6 millisecond burst from generator 11. Simultaneously with the next burst, the other one of switches 31 or 32 is closed for 25 milliseconds. Switches 31 and 32 have a common, normally open circuited terminal connected to an input terminal of automatic gain controlled amplifier 35 by way of series capacitor 36, which enables only AC levels coupled through switches 31 and 32 to be fed to the input of amplifier 35. The gain of amplifier 35 is preset to a predetermined level so that in response to a voltage above a threshold value being induced in one of coils 15 and 16 and coupled to the input of amplifier 35, the amplifier derives a predetermined constant amplitude output having the same frequency as the magnetic field incident on the coil. In response to the input of amplifier 35 being below a threshold level, the amplifier effectively derives a zero level.

Synchronous detector 37 responds to the AC bursts at the output of amplifier 35 which are above the threshold value to determine if these bursts have a carrier frequency equal to the frequency of the AC magnetic field derived from an activated magnetostrictive card 17. In addition, detector 37 determines the duration of bursts having the required carrier frequency. In response to a burst having the required carrier frequency and duration, synchronous detector 37 derives a binary one level which signals that an article containing an activated magneto-strictive card 17 is in the region between tuned coils 12, 13 and untuned coils 15, 16.

To control the operation of receiver 14 so that synchronous detector 37 is energized for the correct time interval associated with activated card 17 being in the region between tuned coils 12, 13 and untuned coils 15, 16 after each burst derived by generator 11, the detector is enabled by an output of frequency synthesizer 38. Synthesizer 38 responds to and is clocked by output pulses of zero crossing detector 39. The output pulses of detector 39 are synchronized with zero crossings of the AC voltage coupled by power line 19 to male plug 22. To this end, zero crossing detector 39 has an input connected to male plug 22, and an output on which a pulse is derived each time a zero crossing of the power line occurs. The pulse output of zero crossing detector 39 is applied to an input of frequency synthesizer 38.

To control the operation of switches 31 and 32 as described supra, logic circuit 41 includes first and second inputs respectively responsive to the output of synchronous detector 37 and frequency synthesizer 38. During normal operation, when synchronous detector 37 derives a binary zero output level to indicate that no activated card is between coils 12, 13 and 15, 16, logic circuit 41 responds to frequency synthesizer 38 so that immediately after first and second successive magnetic field bursts from generator 11, switches 31 and 32 are alternately activated to the closed state. In response to switch 31 being closed at the time synchronous detector 37 derives a binary one level to indicate an enabled card 17 between coils 12, 13 and 15, 16, logic circuit 41 causes switch 31 to be activated to the closed state, while maintaining switch 32 in the open state. This state of switches 31 and 32 is maintained until synchronous detector 37 again derives a binary zero level. If synchronous detector 37 derives a binary one level while switch 32 is closed, logic circuit 41 activates switches 31 and 32 so that these switches are respectively maintained in the open and closed states until a binary zero level is again derived by the synchronous detector.

Untuned coils 15 and 16 are effectively decoupled from the remainder of receiver 14 while magnetic fluxes are being derived from coils 12 and 13 because synchronous detector 37 is effectively disabled while magnetic field bursts are derived from coils 12 and 13. Detector 37, in fact, is enabled by an output of synthesizer 30 only for a predetermined interval immediately after expiration of each on duty cycle portion of transmitter circuits 23 and 30. In addition, during the on duty cycle portions of transmitter circuits 23 and 30, frequency synthesizer 38 causes the gain of amplifier 35 to be reduced to zero, causing a zero output voltage to be coupled by the amplifier to detector 37. To this end, synthesizer 38 includes an output that is coupled as a control input to switch 43 which is normally activated to couple the output of amplifier 35 back to a gain control input of the amplifier. However, in response to the binary one output of frequency synthesizer 38 being coupled to the control input of switch 43, as occurs during the on duty cycle portions of transmitter circuits 23 and 30, switch 43 is activated to couple a negative DC voltage to a bias input of amplifier 35, to drive the amplifier gain to zero. Frequency synthesizer 38 controls synchronous detector 37 so that integrators in the detector are reset to zero during the on duty cycle portions of transmitter circuits 23 and 30.

DC operating power is supplied to amplifiers 33–35, synchronous detector 37, frequency synthesizer 38, zero crossing detector 39 and logic circuit 41 by DC power supply 42, connected to power line 19 by way of male plug 22.

Reference is now made to FIG. 2, a circuit diagram of the circuitry included in transmitter circuits 23 and 30. Because the circuitry in circuits 23 and 30 is identical, the description of FIG. 2 for transmitter circuit 23 suffices for both of circuits 23 and 30.

Transmitter circuit 23 includes a transformerless AC power line to DC power supply 51, shaping circuit 52 responsive to an output of frequency synthesizer and shaper 25, switch means 53, and resonant circuit 54 that includes coil 12. Shaper 52 responds to the output of frequency synthesizer and shaper 25 to supply switch means 53 with out of phase control signals. Switch means 53 is energized by opposite polarity voltages from transformerless power supply 51 to cause a low duty cycle current to flow in series resonant circuit 54 at the frequency supplied to the switch means by shaper 52.

Transformerless AC power line to DC supply 51 includes full wave bridge rectifier 55, consisting of diodes 56–59, connected directly to power line leads 61 and 62. Diodes 56 and 57 include anodes respectively connected to leads 61 and 62, while diodes 58 and 59 include cathodes respectively connected to leads 61 and 62. Diodes 56 and 57 include cathodes having a common connection to electrode 63 of energy storing filter capacitor 64, while diodes 58 and 59 include anodes having a common connection to a negatively biased electrode 65 of capacitor 66. Electrodes 67 and 68 of capacitors 64 and 66 have a common connection at tap 69 of power supply 51. Positive and negative DC voltages are respectively derived at output terminals 71 and 72 of power supply 51, respectively connected to electrodes 63 and 65.

Switch means 53 includes NPN bi-polar transistors 74 and 75, respectively having bases driven by out of phase control voltages from shaper 52. Transistors 74 and 75 include collector emitter paths that are forward biased in response to the voltages supplied to the bases thereof by shaper 52 and which are supplied with positive and negative voltages by terminals 71 and 72 of power supply 51. The collectors and emitters of transistors 74 and 75 are respectively connected to terminals 71 and 72, while the emitter of transistor 74 and the collector of transistor 75 have a common terminal 76. The emitter collector paths of transistor 74 and 75 are respectively shunted by diodes 77 and 78, poled so that current flows in them in a direction opposite from the direction of current flow in the respective shunted collector emitter path.

Tap 69 and common terminal 76 are connected to opposite terminals of series resonant circuit 54, including inductive magnetic field transmitting coil 12, tuning capacitor 81 and resistor 82. The value of capacitor 81 is selected so that circuit 54 is resonant to approximately the same frequency as the switching frequency of transistors 74 and 75 during the on duty cycle portions. However, because of deviations in the values of the inductance of coil 12 and the capacitance of capacitor 81, the resonant frequency of circuit 54 is rarely, if ever, exactly equal to the activation frequency of transistors 74 and 75 during the on duty cycle portion. Resistor 82, which controls the Q of the resonant circuit, helps to assure that sinusoidal currents having very low distortion flow in circuit 54 despite the slight deviations in the resonant frequency of circuit 54 in different generator units relative to the drive frequency of switches 74 and 75 during the on duty cycle portion.

In operation, there is a slight dead time between the end of a forward bias interval for the collector emitter path of transistor switch 74 and the initiation of a forward bias for the collector emitter path of transistor 75 during each 60 KHz cycle of the drive provided for the bases of transistors 74 and 75, and vice versa for forward bias transitions from switch 75 to switch 74. The dead time is provided by shaper 52 responding to a 60 KHz input from synthesizer 25, to supply the bases of transistors 74 and 75 with control signals having the complementary waveforms illustrated in FIGS. 3A and 3B.

Transistors 74 and 75 are respectively forward biased during the positive portions of the waves illustrated in FIGS. 3A and 3B. At all other times, transistors 74 and 75 are back biased. While transistor 74 is forward biased, current flows from electrode 63 of capacitor 64 through terminals 71 and the collector emitter path of transistor 74 to common terminal 76, thence through series resonant circuit 54 to tap 69 and back to the negative electrode of capacitor 64. In response to the collector emitter path of transistor 75 being forward biased, current flows from positive electrode 68 of capacitor 66 through tap 69 to series resonant circuit 54 and the collector emitter path of transistor 75 back to electrode 65 of capacitor 66 by way of terminal 72. Thus, current flows in opposite directions through series resonant circuit 54 during the complementary conduction intervals of transistors 74 and 75.

Because of the low duty cycle forward biasing of transistors 74 and 75, there is a relatively low current drain from capacitors 64 and 66 during each on duty cycle portion. This low duty cycle enables the inexpensive transformerless AC to DC converter 51 to be employed. The maximum duty cycle for activating switching transistors 74 and 75 is determined by several factors, such as the response characteristics of magnetostrictive card 17, synchronous detector 37 of receiver 14, and the circuitry and components of AC to DC converter 51.

Diodes 77 and 78 combine with resistor 82 to enable virtually distortion free sinusoidal current to flow in coil 12, even though the resonant frequency of circuit 54 differs slightly from the drive frequency for the bases of transistors 74 and 75. Because of the energy storage characteristics of coil 12 and capacitor 81, there is a tendency for current to continue to flow in resonant circuit 54 after back biasing of transistors 74 and 75. The dead time between the beginning of back biasing of one of these transistors and the forward biasing of the other transistor enables diodes 78 and 79 shunting the transistor emitter collector paths to absorb the current which has a tendency to continue to flow in resonant circuit 54.

When transistors 74 and 75 are driven with the signals illustrated in FIGS. 3A and 3B, the voltage between tap 69 and common terminal 76 has the waveform illustrated in FIG. 3C. This waveform consists of positive and negative levels respectively equal to the voltages at terminals 71 and 72. Between the positive and negative levels of the waveform of FIG. 3C subsist zero voltage levels coincident with the dead times of transistors 74 and 75.

In response to the voltage between tap 69 and terminal 76 impressed across resonant circuit 54 with a resonant frequency equal to the activation frequency of transistors 74 and 75, a current having the waveshape illustrated in FIG. 3D flows in the resonant circuit 54.

The resulting voltage between tap 69 and terminal 76 is illustrated in FIG. 3E and results from the continuous current flow thru the resonant circuit 54 during the dead time of transistors 74 and 75, via the conduction paths supplied by diodes 77 and 78.

Thus even through there exists a dead time in the drive signals to transistors 74 and 75, the resultant output voltage across the resonant circuit 54 is without deadtime by virtue of the alternate conduction thru diodes 77 and 78 of the current thru the resonant circuit 54. Typically, a positive current having a near zero value flows in circuit 54 from terminal 76 towards tap 69 at the time transistor 74 is initially back biased. This current flows through tap 69 into electrode 68 of capacitor 66, through the capacitor and back to common terminal 76 by way of diode 78. When the current in resonant circuit 54 changes polarity during the dead time interval, positive current flows from resonant circuit 54 to terminal 76 and diode 77 to electrode 63 of capacitor 64.

When the collector emitter path of transistor 75 is forward biased, the current flowing from series resonant 54 continues to flow to terminal 76, but now flows through the low impedance collector emitter path of transistor 75 through capacitor 66 to tap 69. While transistor 75 is forward biased, current drains from capacitor 66 into the load provided by series resonant circuit 54 and transistor 75. Thus, while transistor 75 is forward biased, current flows from tap 69 to terminal 76 through series resonant circuit 54 in a direction opposite from the direction of current flow through the series resonant circuit while transistor 74 is forward biased. When transistor 75 is cut off, the current flowing in resonant circuit 54 through terminal 76 is shifted so that it flows through diode 77 to assist in recharging capacitor 64. Such current flow continues during the dead time until there is a reversal in the direction of current flow in resonant circuit 54, at which time capacitor 66 is supplied with charging current by way of the path completed through diode 78.

During the off duty cycle portion, as subsists for more than 90% of the time with the specified on and off duty cycle durations of 1.6 end 23.4 milliseconds, respectively, the rectified DC voltage supplied to terminals 71 and 72 by diode bridge rectifier 75 causes capacitors 64 and 66 to be recharged.

The value of resistor 82 is selected so that the Q of tuned resonant circuit 54 is at least equal to eight to assist in providing the desired low distortion sinusoidal current. The peak amplitude of the sinusoidal current flowing in resonant circuit 54 is determined to a large extent by the resistance of resistor 82, and is approximately equal to the peak amplitude of the output voltage of inverter 51, between terminals 71 and 72, divided by the resistance of resistor 82.

The frequency of current flowing in series resonant 54 is determined by the 60 KHz operating frequency of transistors 74 and 75, even if there is a deviation in the resonant frequency of circuit 54 from the operating frequency of the transistors. In such a situation, diodes 77 and 78 conduct the leading and lagging currents which respectively flow in resonant circuit 54 in response to the activation of frequency of transistors 74 and 75 being respectively less than and greater than the resonant frequency of circuit 54.

Because of the switch-mode operation of transmitter circuit 23, wherein transistors 74 and 75 are operated in fully on and fully off modes, the power dissipation level of the circuit is much lower than prior art devices. The switch-mode operation of transmitter 11 with the resonant load provided by circuit 54 reduces stresses and switching losses of transistors 74 and 75, to increase reliability and efficiency of the device.

Figure 4:
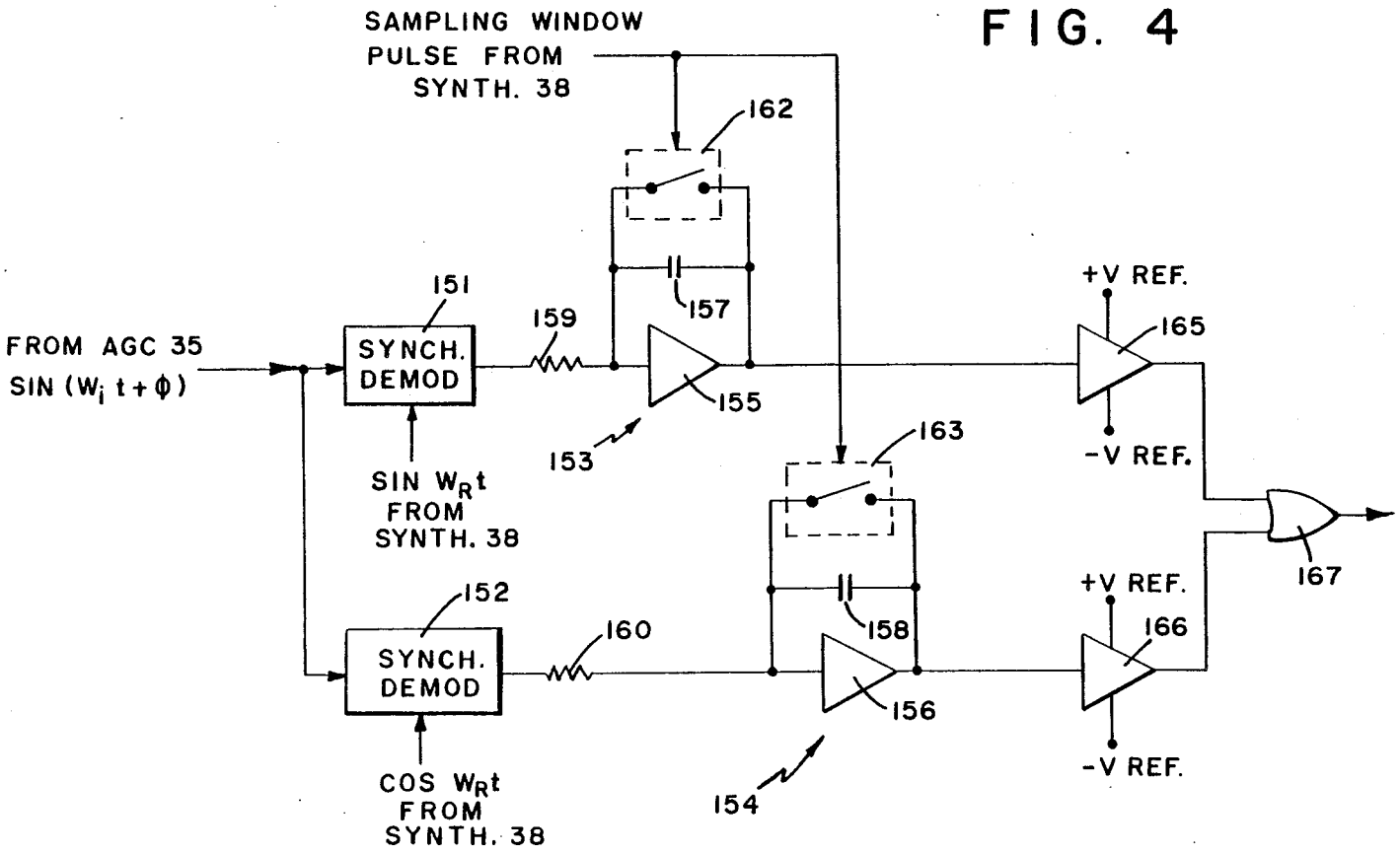
FIG. 4 is a schematic and circuit block diagram of the synchronous detector in the receiver in the system of FIG. 1.

Reference is now made to FIG. 4 of the drawing wherein synchronous detector 37 is illustrated as including synchronous demodulators 151 and 152, driven in parallel by the output of AGC amplifier 35. When an activated magneto-strictive card 17 is in the region between tuned transmitter coils 12, 13 and untuned receiver coils 15, 16, the output of amplifier 35, at the inputs of demodulators 151 and 152, can be assumed to be a constant amplitude sinusoid, except while coils 12 and 13 are excited during the on-duty cycle portion of generator 11. The sinusoidal input signal to demodulators 151 and 152 from amplifier 35 can be assumed to vary in accordance with:

$$\sin(\omega_i t+\phi),$$

where:

$\omega_i$ is the angular frequency of the AC wave derived from enabled card 17 after the on-duty cycle portion of transmitter 11 has terminated, t=time, and $\phi$=the variable unpredictable phase of the carrier wave frequency derived from the structure on enabled card 17, as incident on the coil 15 or 16 feeding the remainder of the receiver.

For the purposes of this description it is assumed that the sinusoidal inputs to demodulators 151 and 152 subsist for the entire off-duty cycle portion of transmitter 11. In actuality, however, the sinusoidal inputs to demodulators 151 and 152 are damped sinusoids having a finite value during only a portion of the off-duty cycle portions of transmitter 11. When the amplitude of the damped sinusoid drops below a certain level, the inputs to demodulators 151 and 152 drop to zero, because of the characteristics of amplifier 35. As long as the sinusoid is above a predetermined level, the output amplitude of amplifier 35 is constant. The length of the constant amplitude sinusoidal output of amplifier 35 during each off-duty cycle portion of generator 11 is variable, as a function of the orientation of card 17 relative to tuned transmitter coils 12, 13 and untuned receiver coils 15, 16, as well as the location of the card in the region between the coils. However, due to the detection process employed in detector 37, the number of cycles of the carrier frequency $\omega_i$, from a typical enabled card in the region is sufficient to cause accurate detection of the card.

Synchronous detectors 151 and 152 are driven by orthogonal components of a reference wave, assumed to have a reference phase. The second inputs of synchronous demodulators 151, 152 can be respectively represented by:

$$\sin\omega_R t, \text{ and}$$

$$\cos\omega_R t,$$

where:

$\omega_R$=the angular frequency of the reference wave, which in turn is equal to the frequency of the AC carrier wave derived from the structure on card 17.

Synchronous demodulator 151 responds to the $\sin(\omega_i t+\phi)$ and $\sin\omega_R t$ inputs thereof to derive an output represented by:

$$\sin(\omega_i t+\phi\sin\omega_R t.$$

Similarly, synchronous demodulator 152 multiplies the two input signals thereof to derive an output signal represented by:

$$\sin(\omega_i t+\phi)\cos\omega_R t.$$

The output signals of synchronous demodulators 151 and 152 are bipolarity signals that vary between plus and minus reference values, dependent upon the relative values of $\omega_i$, $\phi$ and $\omega_R$. In response to $\omega_i$ and $\omega_R$ being equal, the outputs of demodulators 151 and 152 are DC voltages. If, however, $\omega_i$ differs from $\omega_R$ because $\omega_i$ originates from a signal source other than card 17, demodulators 151 and 152 derive AC signals at the sum and difference frequencies $(\omega_i+\omega_R)$ and $(\omega_i-\omega_R)$. The indicated responses at the outputs of demodulators 151 and 152 are considered only for the difference or beat frequency $(\omega_i-\omega_R)$. No consideration of the sum frequency $(\omega_i+\omega_R)$ is necessary because the integration performed by detector 37 reduces these high frequency components to insignificant levels.

The output signals of demodulators 151 and 152 are respectively applied to analog signal integrators 153 and 154. Integrators 153 and 154 are standard integrators including high gain DC operational amplifiers 155 and 156, feedback capacitors 157 and 158, as well as input resistors 159 and 160. Integrators 153 and 154 are reset to zero, except during a sampling window having a duration T, during which the integrators are effectively responsive to output signals of demodulators 151 and 152. To this end, capacitors 157 and 158 are short-circuited by switches 162 and 163 which shunt them, except during the sampling window, which begins almost immediately after the expiration of each on-duty cycle portion of transmitter 11. Switches 162 and 163 are simultaneously driven into the closed and open states by an output of synthesizer 30. The duration of sampling window T depends on the desired bandpass of synchronous detector 37, as described infra. The sampling window begins simultaneously with the AGC amplifier 37 being switched into an operative condition by switch 43 being coupled between the output of the amplifier and the bias input thereof.

The output levels of integrators 153 and 154 are constantly monitored by comparators 165 and 166, respectively. Comparators 165 and 166 normally derive binary zero level outputs. However, in response to the absolute value of the inputs of comparators 165 and 166 exceeding a reference value, $V_{REF}$, the comparators derive binary one output levels. The binary one output levels of comparators 165 and 166 are combined in OR gate 167. A binary one level is thus derived from OR gate 167 in response to the absolute value of the integrated response over the sampling window exceeding reference value $V_{REF}$. Comparators 165 and 166 derive the stated outputs in response to DC reference levels $+V_{REF}$ and $-V_{REF}$ being supplied thereto by DC supply 42.

Signal integrators 153 and 154 derive output voltages which linearly increase with time in response to DC outputs of synchronous demodulators 151 and 152 in accordance with:

$$V_1 = \int_0^T [\sin(\omega_i t + \phi)\sin\omega_R t]dt, \text{ and}$$

$$V_2 = \int_0^T [\sin\omega_i t + \phi)\cos\phi_R t]dt.$$

For the case where frequency $\omega_i$ is the same as reference frequency $\omega_R$, as subsists when enabled card 17 is in the region between the transmitter and receiver coils, the output signals of integrators 153 and 154 at the completion of the sampling window, and prior to closure of switches 162 and 163, are respectively represented by $V_1=T/2 \cos \phi$ and $V_2=T/2 \sin \phi$. Hence, the amplitudes at the outputs of integrators 153 and 154 are solely proportional to the duration of receiver sampling window T and the relative phase angle $\phi$ between the signal coupled in parallel to demodulators 151 and 152 and the reference phase for $\omega_R$.

Because the relative phase angle $\phi$ is unpredictably variable between 0° and 360°, voltages $V_1$ and $V_2$ are bi-polarity voltages, having an amplitude indicative of $\phi$. This is why it is necessary to compare the absolute values of the outputs of integrators 153 and 154 with the reference level $V_{REF}$. The magnitude of $V_{REF}$ is selected so that the constant amplitude sinusoidal input $\sin(\omega_i t+\phi)$ supplied to demodulators 151 and 152 results in a binary one output of each of comparators 165 and 166 when $\phi=45°$. The value of $V_{REF}$ can be determined to be equal to approximately 0.35T by equating $V_1=T/2 \cos \phi$ for $\phi=0$, by using the actual value of $V_1$ at time T and taking into account the input amplitude level and transfer function of integrators 153 end 154. This value of $V_1$ is multiplied by cos 45° (equal approximately to 0.707), resulting in T/2 cos 45°=0.35T. By setting $V_{REF}=0.35T$ all input signals having a frequency $\omega_i=\omega_R$ are detected, regardless of phase since either $V_1$ or $V_2$ is never less than 0.35T.

The duration of window T determines the effective bandpass of synchronous detector 37. If window T is long enough, any frequency $\omega_i$ which differs from $\omega_R$ will not be detected. This is because the beat frequencies derived by demodulators 151 and 152 ultimately are averaged by integrators 153 and 154 to a zero level. For the case of $\omega_i$ not equal to $\omega_R$, the output voltages of integrators 153 and 154, at the completion of sampling window T are represented by:

$$V_1 = \int_0^T [\sin(\omega_i t + \phi)\sin\omega_R t]dt = \frac{\sin[(\omega_i - \omega_R)t + \phi]}{2(\omega_i - \omega_R)},$$

-continued and $$V_2 = \int_0^T [\sin(\omega_i t + \phi)\cos\omega_R t]dt = \frac{-\cos[(\omega_i - \omega_R)t + \phi]}{2(\omega_i - \omega_R)}$$

Thus, integrators 153 and 154 respond to the beat frequencies, $(\omega_i-\omega_R)$, derived from demodulators 151 and 152. Integrators 153 and 154 average the sum frequencies, $(\omega_i+\omega_R)$, to insignificant levels, whereby the sum frequencies have no effect on the values of $V_1$ and $V_2$.

The band width of the demodulation and integration process can be determined by evaluating the two last presented equations at time t=0 and any other time t between zero and the maximum duration that the sinusoidal voltage can be derived from demodulators 151 and 152 for a response from magneto-strictive card 17. The band width $(\omega_i-\omega_R)$ or $(\omega_R-\omega_i)$ is determined by using the actual values for time T and the input amplitude level and transfer functions of integrators 153 and 154 to calculate the magnitudes of $V_1$ and $V_2$. Taking into account the previously calculated value for $V_{REF}=0.35T$, the pass band of detector 37 is equal to $\pm 1/2T$. Typically, T=1.6 milliseconds, to provide the system with a pass band of approximately ±300 Hz.

The synchronous demodulator-integration process achieved by demodulators 151 and 152 and integrators 153 and 154 thus has a narrow frequency bandpass for long term sinusoidal signals, without including any tuned components. In addition, the demodulation-integration process is immune to impulse type noise, even though an impulse contains energy at all frequencies, including $\omega_R$. The energy at any particular frequency, including $\omega_R$, has a short duration which prevents the output signals of integrators 153 and 154 from having an absolute value in excess of reference value $V_{REF}$. Thus, receiver 14 is capable of discriminating an input signal having a frequency $\omega_R$, with a variable unpredictable phase, and predetermined time position in the presence of background energy, as subsists in impulse type noise. This is because of the synchronous detection process provided by synchronous demodulators 151 and 152 and the time duration detecting process involving signal integrators 153 and 154.

Figure 5:
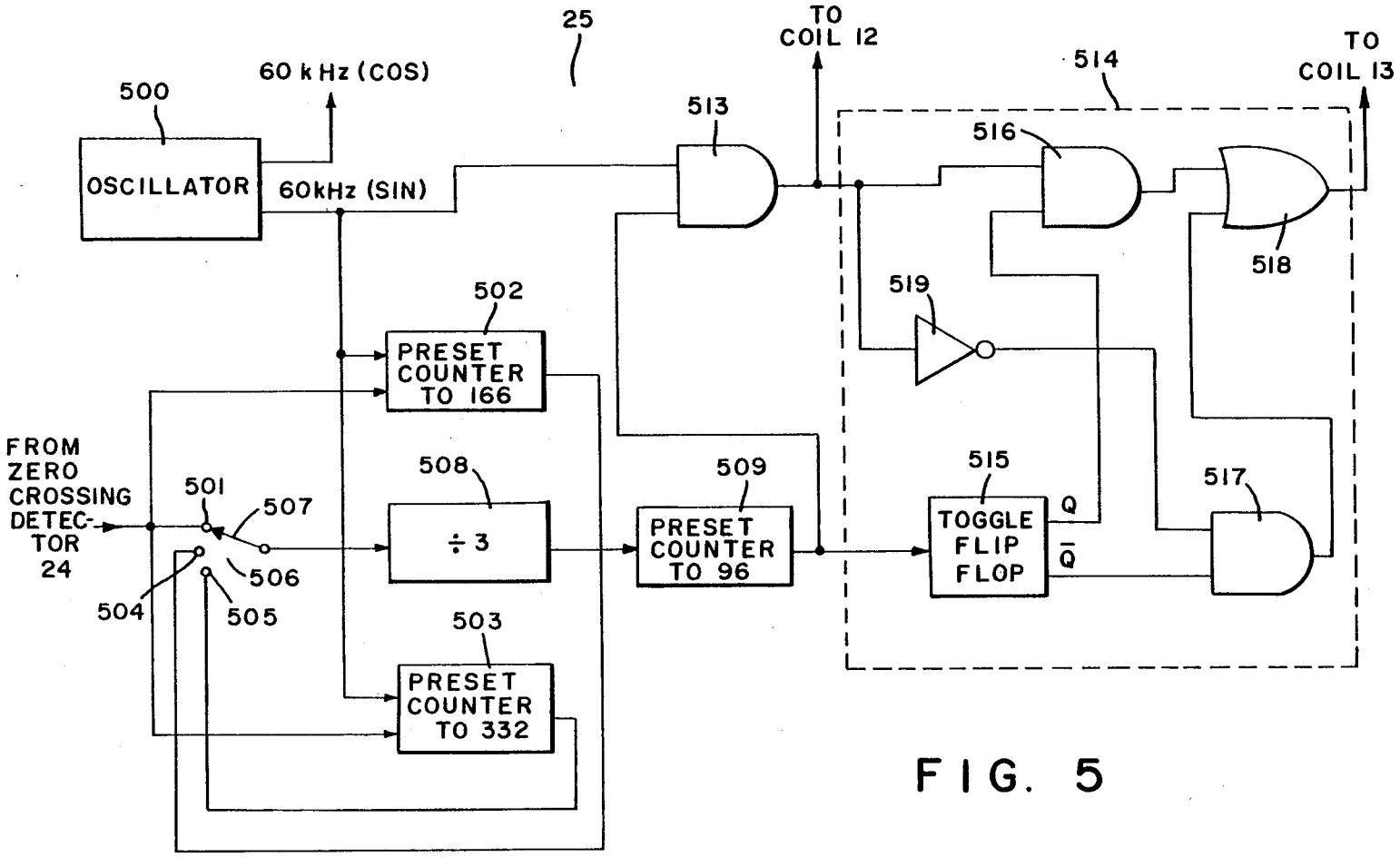
FIG. 5 is a block and circuit diagram of the synthesizer of the generator in FIG. 1.

Reference is now made to FIG. 5 of the drawing wherein details of transmitter synthesizer 25 are illustrated. Synthesizer 25 responds to the pulses derived from zero crossing detector 24 to control energization of transmit circuits 23 and 30. Synthesizer 25 includes provision for compensating for the 120° and 240° phase displacement that is likely to subsist between the voltages at plugs 21 and 22. The compensation causes receiver 14 to be enabled immediately after expiration of the on-duty cycle portions of transmitter 11. An installer of the system of the invention merely must set one switch in each of transmitter 11 and receiver 14 to appropriate positions to provide the desired compensation. The installer determines which switch positions are necessary by either measuring the relative phases at the outlets connected to plugs 21 and 22 or activates generator 11 with the switches of the generator and receiver 14 in the three possible positions thereof to determine when a correct response is produced by the receiver while card 17 is in the region between tuned transmitter coils 12, 13 and untuned receiver coils 15, 16.

To these ends, the 120 Hz output signal of zero crossing detector 24 is supplied in parallel to contact 501, as well as to an enable input of each of preset counters 502 and 503. The preset counts of counters 502 and 503 are respectively 166 and 332. Counters 502 and 503 have count inputs driven by the 60 KHz output of oscillator 500. Pulses are respectively derived at the outputs of counters 502 and 503 at intervals that are respectively delayed from or displaced by 2.77 and 5.55 milliseconds from each zero crossing output pulse of detector 24; these intervals are respectively equal to 120° and 240° of the 60 Hz power line frequency at plug 21. Each time a zero crossing pulse is applied to the enable input of counters 502 and 503 by detector 24, the counters count the 60 KHz output of oscillator 500 up to the preset counts thereof. When the preset counts of counters 502 and 503 are reached, operation of the particular counter ceases until that particular counter receives another zero crossing pulse from detector 24. When the preset counts of counters 502 and 503 are reached, the counters derive short duration pulses that are coupled to contacts 504 and 505.

The output pulses of counters 502 and 503 are respectively applied to contacts 504 and 505 of manually controlled three-position switch 506, including armature 507. Armature 507 is positioned to engage terminals or contacts 501, 504 and 505 when the single phase 60 Hz voltages at plugs 21 and 22 in phase, 120° displaced and 240° displaced, respectively.

Armature 507 of switch 506 is permanently connected to divide by three frequency divider 508, which derives a 40 Hz pulse output train. The 40 Hz pulse train determines the frequency of the inductive magnetic fields derived from coils 12 and 13 (but not the carrier frequency). The magnetic fields are derived from coils 12 and 13 at a frequency that is anharmonically related to 60 Hz to assist in providing a secure system that is immune to persons who use devious means to desensitize the system. Such persons would normally think that the 60 KHz bursts are derived at a frequency of 60 Hz or a harmonic of 60 Hz. By utilizing a burst occurrence frequency that is anharmonically related to 60 Hz, such desensitizing or jamming can be reduced. In addition, there is a reduction of 60 Hz interference effects in generator 11 and receiver 14 through the use of a burst occurrence frequency that is anharmonically related to the 60 Hz power line frequency.

The 40 Hz output of frequency divider 508 is coupled to preset counter 509 that responds to the pulses on armature 507 and to the 60 KHz output of oscillator 500 in a manner similar to the manner in which counters 502 and 503 operate. The count of counter 509 is preset to a value of 96, to provide the 1.6 millisecond on-duty cycle duration for transmitter 11. For the entire time that counter 509 is counting up to 96, it derives a binary one output level which is coupled to an enable input of AND gate 513, causing the gate to pass the 60 KHz output of oscillator 500. Thus, 96 cycles of the 60 KHz output of oscillator 500 are passed through AND gate 513 while counter 509 is counting to its preset value of 96. The 60 KHz output of AND gate 513 is applied to shaper 42 of transmit circuit 23. Shaper 42 responds to the 60 KHz oscillations to provide the dead times discussed supra. Ninety-six cycles of 60 KHz current are thereby supplied to coil 12 for 1.6 milliseconds every 25 milliseconds, at a time position synchronized by the zero crossings of the power line connected to plug 21.

Control of the polarity for the ninety-six cycles of the 60 KHz output of coil 13 is provided by circuit 514. Circuit 514 inverts the 60 KHz output of oscillator 500 during alternate on-duty cycle durations of transmit circuit 30, to enable alternate in-phase and out-of-phase AC inductive magnetic fields to be derived. Circuit 514 includes toggle flip-flop 515 responsive to the trailing edge output of counter 509. Toggle flip-flop 515 includes complementary Q and $\overline{Q}$ outputs, having a frequency one-half that of the output of counter 509; transitions in the Q and $\overline{Q}$ outputs are synchronized with the expiration of each magnetic field derived from transmitter 11. The Q and $\overline{Q}$ outputs of flip-flop 515 are respectively applied to enable inputs of AND gates 516 and 517, respectively driven by uninverted and inverted replicas of the 60 KHz output of AND gate 513; inverter 519 is connected between the output of AND gate 513 and an input of AND gate 517 to provide the inversion. The outputs of AND gates 516 and 517 are coupled to OR gate 518, which drives coil 13.

During alternate 1.6 millisecond on-duty cycle durations, while the Q output of flip-flop 515 has a binary one level, AND gate 516 is enabled to pass the uninverted 60 KHz output AND gate 513 to OR gate 518. During the other on-duty cycle durations, the $\overline{Q}$ output of flip-flop 515 enables AND gate 517 to pass the inverted 60 KHz output of inverter 519 to coil 13 by way of OR gate 518.

Figure 6:
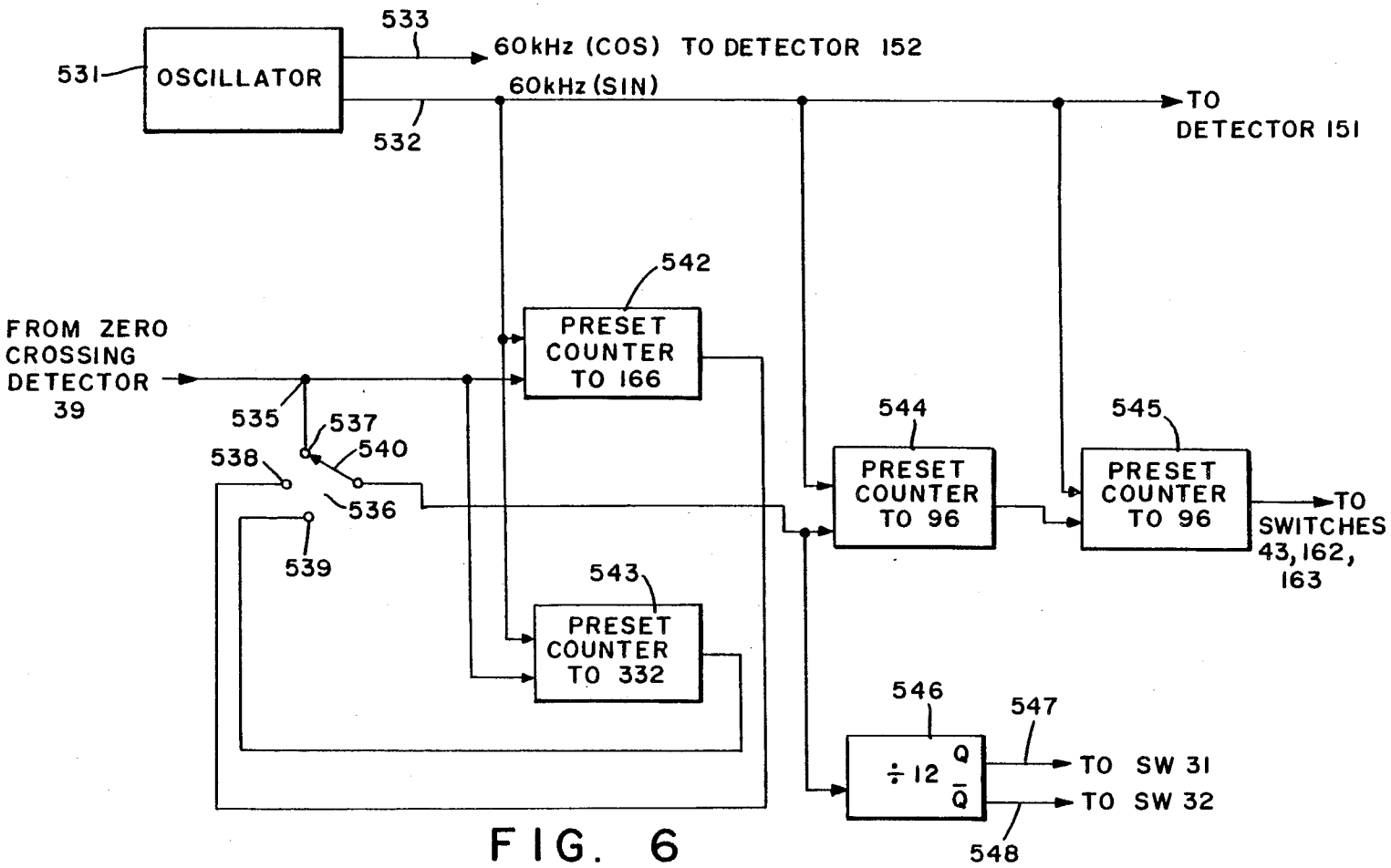
FIG. 6 is a block and circuit diagram of the synthesizer in the receiver in the system of FIG. 1.

Consideration is now given to synthesizer 38 of receiver 14, by reference to FIG. 6. Synthesizer 38 causes receiver 14 to be enabled at a frequency that is three times greater than the 40 Hz activation frequency of transmitter or generator 11. Enabling receiver 14 at a frequency that is an integral multiple of the operating frequency of generator 11 assists in making the system more difficult to jam and enables a single receiver to be responsive to multiple transmitters in the same vicinity. Receiver 14 is synchronized so that it can be responsive to multiple transmitters, powered by phase displaced AC power line voltages.

Synthesizer 38 includes free running 60 KHz oscillator 531, having output leads 532 and 533 on which are derived 60 KHz waves that are phase displaced from each other by 90° and, thereby, can be respectively considered as sine and cosine waves. The sine and cosine waves on leads 532 and 533 are respectively applied to synchronous demodulators 151 and 152 in synchronous detector 37.

The sine wave on lead 532 is also used to establish 1.6 millisecond wide receiver sampling windows, which subsist in receiver 14 immediately after expiration of each possible 1.6 millisecond, 60 KHz burst of each of generators 11, following a zero crossing at the power line input of the generator. In other words, receiver 14 is, in the preferred embodiment, enabled three times during each 40 Hz operating cycle of generator or transmitter 11. These three enablement times are synchronized with the three possible time positions of the 40 Hz on duty cycle portions of the 60 KHz wave derived by transmitter 11. Compensation is made for the phase of the power line voltage at plug 22 of receiver 14.

To these ends, the 120 Hz output pulse waveform of zero crossing detector 39 is applied to terminal 535 of three-position switch 536, including contacts 537–539, and armature 540. Armature 540 engages contacts 537, 538 and 539 to provide 0°, 60° and 120° phase delay for the possible 0°, 120° and 240° phase displacement of the AC power line voltage at plug 22 relative to the power line voltage at plug 21. To provide appropriate delays for 120° and 240° phase displacements of the power line voltage at plug 22, the pulse waveform at terminal 535 is applied in parallel to enable inputs of preset counters 542 and 543, having count inputs driven in parallel by the 60 KHz sine wave on lead 532. Counters 542 and 543 are respectively preset to counts of 166 and 332 to provide time delays of 2.77 and 5.55 milliseconds. The output pulses of counters 542 and 543 are thereby phase displaced by 60° and 120° relative to the 60 Hz zero crossings at plug 22. Contact 540 is adjusted to engage contacts 537, 538 and 539, so that pulses on the contact are either in phase with zero crossings at plug 22, are phase displaced by 60° with the 60 Hz zero crossings at plug 22, or are phase displaced by 120° with the zero crossings at plug 22.

The pulses on contact 540 are applied to an enable input of preset counter 544, having a count input responsive to the 60 KHz wave on lead 532. Counter 544 is preset to a count of 96, thereby to derive a trailing edge that is time displaced by 1.6 milliseconds from the pulses on contact 540. Thus, the trailing edge of the output of counter 544 occurs simultaneously with each possible expiration of a 60 KHz burst from transmitter 11.

The trailing edge of the output of preset counter 544 initiates an enable cycle of receiver 14. The trailing edge output of preset counter 544 is supplied to an enable input of preset counter 545, having a count input responsive to the 60 KHz wave on lead 532. Counter 545 is preset to a count of 96, to establish a 1.6 millisecond receiver sampling window. During the 1.6 milliseconds while counter 545 is counting the 60 KHz wave on lead 532 to a count of 96, the counter derives a binary one output level. During the interval while counter 545 derives a binary one output level, AGC switch 43 and capacitor discharge switches 162 and 163 are activated so that the receiver is effectively enabled. In particular, while the binary one output level is derived by counter 545, switches 162 and 163 are open circuited, while switch 43 is energized to establish the AGC feedback path for amplifier 35, such that the amplifier is not cutoff by the negative DC bias voltage applied to switch 43. If the output of OR gate 167 is sufficiently great during this interval, a binary one level is derived by OR gate 167 to indicate the presence of an activated card in the surveillance region.

Because receiver 14 is enabled at a frequency which is three times that of the 60 KHz output bursts of generator 11, and the possibility of more than one generator being in a region to which receiver 14 is responsive, and the different, alternate phases of the inductive fields that are derived by one transmitter or generator 11, it is necessary for untuned receiver coils 15 and 16 to stay in the same condition for six successive enablement cycles of the receiver. In other words, switch 31 is closed while switch 32 is open during six successive enablement cycles of receiver 14, and vice versa. Switches 31 and 32 must be switched between the open and closed states in synchronism with the remainder of receiver 14 being enabled. To this end, the 120 Hz, phase synchronized pulse waveform on armature 540 is coupled to an input of divide by twelve frequency divider 546. Frequency divider 546 has complementary Q and $\overline{Q}$ outputs on leads 547 and 548. The complementary binary signals on leads 547 and 548 are applied as control inputs to switches 31 and 32, respectively. In response to the signals on leads 547 and 548 having binary one and zero levels, switches 31 and 32 are respectively closed and opened. Because of the divide by twelve factor of divider 546, switch 31 remains closed for six enablement cycles of receiver 14, followed by switch 32 being closed for six successive enablement cycles of the receiver.

Figure 7:
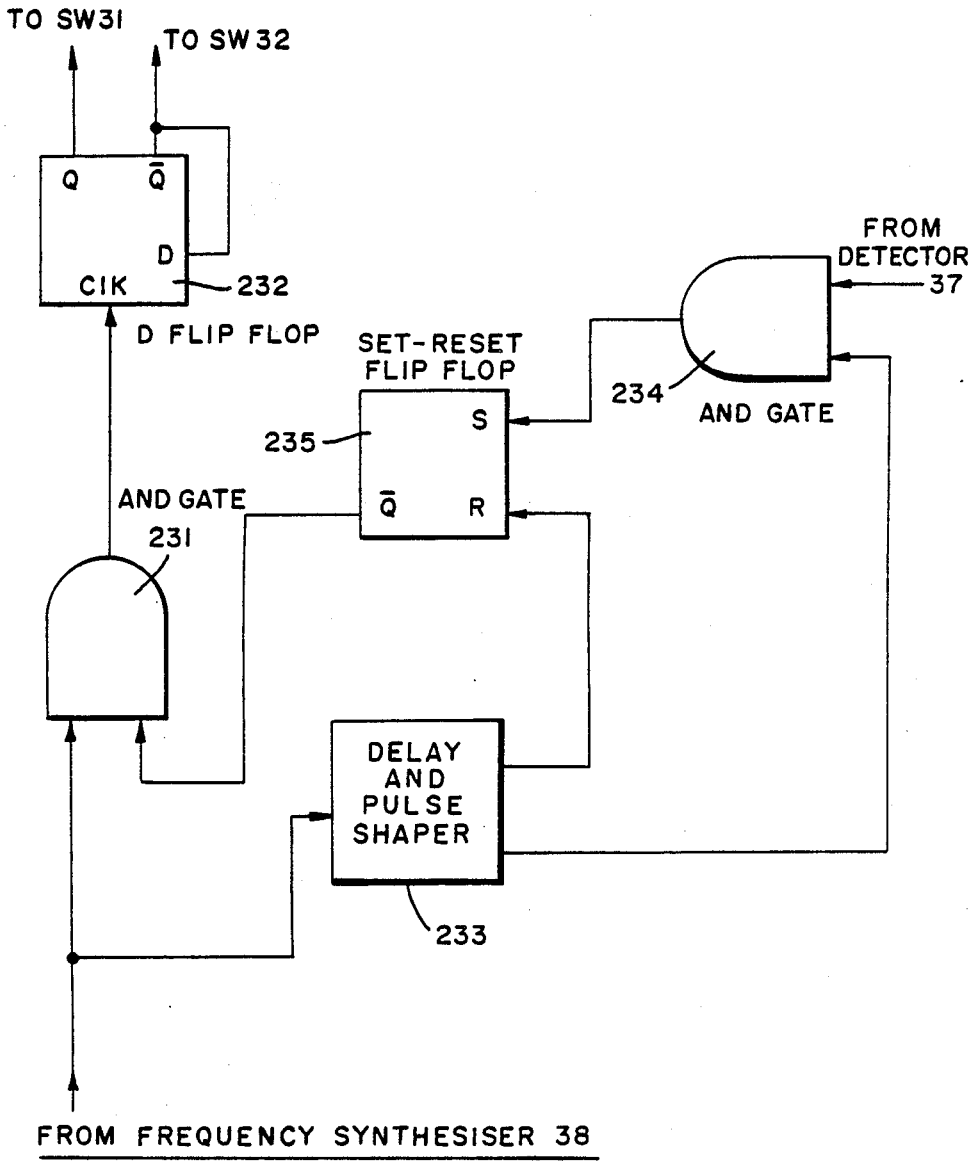
FIG. 7 is a circuit diagram of the logic circuit included in the receiver circuit of FIG. 1.

To achieve these ends, logic circuit 41, as illustrated in FIG. 7, is included. Basically, logic circuit 41 responds to frequency synthesizer 38 to alternately close switches 31 and 32 during different successive detection cycles of receiver 14, which occur Immediately after successive, different alternate on duty cycle portions of coils 12 and 13. In response to one of coils 15 or 16 causing detector 37 to derive an output indicative of the presence of card 17 in surveillance zone 201, logic circuit 41 maintains the switch which was closed in a closed condition.

To these ends, logic circuit 41 includes AND gate 231 having a first input responsive to an output of frequency synthesizer 38 at the 40 Hz activation frequency of the on duty cycle portions of generator 11. Frequency synthesizer 38 supplies gate 231 with a short duration binary one level coincident with the start time of each on duty cycle portion of transmitter circuits 23 and 30. Gate 231 is normally enabled to pass the output of frequency synthesizer 39 to a clock input terminal of toggle or D flip-flop 232, having complementary Q and $\overline{Q}$ outputs which respectively control opening and closing of switches 31 and 32. In response to the Q output of flip-flop 232 having binary one and zero states, switch 31 is respectively closed and opened. Similarly, binary one and zero states for the $\overline{Q}$ output of flip-flop 232 result in switch 32 being closed and opened.

Pulses from frequency synthesizer 38 are inhibited by AND gate 231 in response to synchronous detector 37 detecting a 60 KHz response from card 17. To these ends, the output of synthesizer 38 is coupled to delay network and pulse shaper circuit 233. Circuit 233 derives a short duration output pulse that is delayed relative to the input of gate 231 from synthesizer 38 by a sufficient time to enable derivation by detector 37 of a binary one signal indicating the presence of magnetostrictive card 17. This pulse output of circuit 233 is applied to AND gate 234. The output of gate 234 is applied to the set input of set-reset flip-flop 235.

Delay and pulse shaper circuit 233 also generates a second output in the form of a short duration pulse coincident with the termination of the on duty cycle portion of transmitter circuits 23 and 30. This second output is applied to the reset input of set-reset flip-flop 235.

In response to detector 37 deriving a binary one output to indicate the presence of card 17, gate 234 is enabled to cause the $\overline{Q}$ output of flip-flop 235 to be set to the zero state.

In contrast, in response to detector 37 deriving a binary zero output while a pulse is derived from circuit 233, AND gate 234 remains in its binary zero state hence the $\overline{Q}$ output of flip flop 235 remains in a binary one state initiated by the reset pulse output of circuit 233.

When the $\overline{Q}$ output of flip flop 235 is set to its binary zero state in response to detector 37 indicating the presence of card 17, the output of AND gate 231 is disabled. This prevents the output of frequency synthesizer 38 from clocking D flip flop 232 at the 40 Hz activation frequency of the on duty cycle portions of generator 11.

Therefore, the Q and $\overline{Q}$ binary output states of flip flop 232 which control the on and off states of switches 31 and 32 respectively, are preserved. Hence the states of switches 31 and 32 are maintained until the AND gate 231 allows the frequency synthesizer 38 to further clock flip flop 232. The clocking of flip flop 232 does not resume until detector 37 ceases to derive a binary one level indicating that card 17 is no longer present in surveillance zone 201. When detector 37 derives a binary zero level indicating the absence of card 17, the $\overline{Q}$ output of flip flop 235 remains in its binary one state as a result of being reset by the pulse generated by delay and pulse shaper 233.

Therefore, the clocking of flip flop 232 and hence alternate selection of switches 31 and 32 is resumed.

While there has been described and illustrated one specific embodiment of the invention, it will be clear that variations in the details of the embodiment specifically illustrated and described may be made without departing from the true spirit and scope of the invention as defined in the appended claims.

I claim:

1. An article surveillance system wherein a structure responds to a first pulsed inductive magnetic field to derive a second pulsed inductive magnetic field having a predetermined occurrence time relative to the occurrence time of the first magnetic field comprising AC power line activated transmitter means for periodically deriving the first pulsed inductive magnetic field, AC power line activated receiver means responsive to the second pulsed inductive magnetic field, means for synchronizing the occurrence time of the first magnetic field and the activation of the receiver means so the receiver means is activated while the second magnetic field is incident on coil means of the receiver means, said synchronizing means including first and second separate zero crossing detectors for power lines activating the transmitter means and the receiver means, the first and second zero crossing detectors being respectively included in the transmitter and receiver means.

2. The system of claim 1 wherein the power lines activating the transmitter and receiver are likely to have zero crossings at different predetermined time positions, and further including means in at least one of the transmitter and receiver means for compensating for the different predetermined time positions of the zero crossings.

3. The system of claim 2 wherein the compensating means for one of said transmitter and receiver means includes preset counter means responsive to a signal having an occurrence time controlled by the zero crossing time of the power line activating said one means, and switch means for selectively controlling the preset count of said counter means.

4. The system of claim 3 wherein said zero crossing detectors derive output pulses in synchronism with the power line zero crossings, and said synchronizing means includes means for frequency dividing the output pulses to a wave train having a frequency that is anharmonically related to the power line frequency, said switch means coupling the wave train to said counter means.

5. The system of claim 3 wherein said zero crossing detectors derive output pulses in synchronism with the power line zero crossings, and said synchronizing means includes means for frequency dividing the output pulses to a wave train having a frequency that is anharmonically related to the power line frequency.

6. The system of claim 2 wherein the receiver means includes means for enabling the receiver means to effectively detect the second pulsed inductive magnetic field at a frequency that is an integral multiple of the frequency that the first magnetic field is derived by the transmitter means.

7. The system of claim 6 wherein the transmitter means includes means for generating the first pulsed magnetic field so alternate pulses thereof have different magnetic field phase relations, the receiver means including: coil means effectively having first and second different spatial coverage regions, means for activating the coil means to alternately cover the first and second spatial regions so each region is covered during a plurality of consecutive enabling cycles of the receiver means during which at least one first pulsed magnetic field is derived.

8. The system of claim 7 wherein the receiver means coil activating means includes means for alternating the first and second spatial regions during a search phase for the second pulsed magnetic field, and means responsive to detection of the second pulsed magnetic field for maintaining the coil means locked onto the spatial region it was in at the time the second pulsed magnetic field was detected, said coil means being activated to return to alternating the first and second regions in response to the second pulsed magnetic field not being detected.

9. The system of claim 1 wherein the structure derives the second magnetic field immediately after expiration of the first magnetic field, the receiver means including means responsive to the second zero crossing detector for effectively disabling the receiver means while the first magnetic field is being derived and for effectively enabling the receiver means for a predetermined interval immediately after expiration of the first magnetic field.

10. The system of claim 9 wherein the power lines activating the transmitter and receiver are likely to have zero crossings at different predetermined time positions, and further including means in at least one of the transmitter and receiver means for compensating for the different predetermined time positions of the zero crossings.

11. The system of claim 10 wherein the compensating means for one of said transmitter and receiver means includes preset counter means responsive to a signal having an occurrence time controlled by the zero crossing time of the power line activating said one means, and switch means for selectively controlling the preset count of said counter means.

12. The system of claim 11 wherein said zero crossing detectors derive output pulses in synchronism with the power line zero crossings, and said synchronizing means includes means for frequency dividing the output pulses to a wave train having a frequency that is anharmonically related to the power line frequency, said switch means coupling the wave train to said counter means.

13. The system of claim 9 wherein the receiver means includes means for enabling the receiver means to effectively detect the second pulsed inductive magnetic field at a frequency that is an integral multiple of the frequency that the first magnetic field is derived by the transmitter means.

14. The system of claim 13 wherein the transmitter means includes means for generating the first pulsed magnetic field so alternate pulses thereof have different magnetic field phase relations, the receiver means including: coil means effectively having first and second different spatial coverage regions, means for activating the coil means to alternately cover the first and second spatial regions so each region is covered during a plurality of consecutive enabling cycles of the receiver means during which at least one first pulsed magnetic field is derived.

15. The system of claim 14 wherein the receiver means coil activating means includes means for alternating the first and second spatial regions during a search phase for the second pulsed magnetic field, and means responsive to detection of the second pulsed magnetic field for maintaining the coil means locked onto the spatial region it was in at the time the second pulsed magnetic field was detected, said coil means being activated to return to alternating the first and second regions in response to the second pulsed magnetic field not being detected.

16. The system of claim 1 wherein the receiver means includes means for enabling the receiver means to effectively detect the second pulsed inductive magnetic field at a frequency that is an integral multiple of the frequency that the first magnetic field is derived by the transmitter means.

17. The system of claim 16 wherein the transmitter means includes means for generating the first pulsed magnetic field so alternate pulses thereof have different magnetic field phase relations, the receiver means including: coil means effectively having first and second different spatial coverage regions, means for activating the coil means to alternately cover the first and second spatial regions so each region is covered during a plurality of consecutive enabling cycles of the receiver means during which at least one first pulsed magnetic field is derived.

18. The system of claim 17 wherein the receiver means coil activating means includes means for alternating the first and second spatial regions during a search phase for the second pulsed magnetic field, and means responsive to detection of the second pulsed magnetic field for maintaining the coil means locked onto the spatial region it was in at the time the second pulsed magnetic field was detected, said coil means being activated to return to alternating the first and second regions in response to the second pulsed magnetic field not being detected.

* * * * *